US007388558B1

(12) United States Patent
Jacoletti et al.

(10) Patent No.: US 7,388,558 B1
(45) Date of Patent: Jun. 17, 2008

(54) PROTECTIVE COVER FOR A SATELLITE DISH

(75) Inventors: William L. Jacoletti, St. Thomas (CA); Terance M. Pitcher, Toronto (CA)

(73) Assignee: 1571014 Ontario Ltd., St. Thomas, Ontario (CA)

( * ) Notice: Subject to any disclaimer, the term of this patent is extended or adjusted under 35 U.S.C. 154(b) by 0 days.

(21) Appl. No.: 11/638,447

(22) Filed: Dec. 14, 2006

(51) Int. Cl.
*H01Q 1/42* (2006.01)

(52) U.S. Cl. ..... 343/872

(58) Field of Classification Search ..... 343/872, 343/912, 840

See application file for complete search history.

(56) References Cited

U.S. PATENT DOCUMENTS

| | | | | |
|---|---|---|---|---|
| 5,451,972 | A | 9/1995 | Franklin | |
| 5,528,253 | A | 6/1996 | Franklin | |
| 5,729,241 | A | 3/1998 | Ergen et al. | |
| 5,815,125 | A | 9/1998 | Kelly et al. | |
| 5,940,047 | A | 8/1999 | Pfnister | |
| 6,714,167 | B1 | 3/2004 | Gusick, Jr. | |
| 6,933,908 | B1 | 8/2005 | Mirabueno | |
| 7,161,553 | B2 * | 1/2007 | Courtney | 343/872 |
| 7,215,300 | B1 * | 5/2007 | Reid, Jr. | 343/872 |
| 7,277,064 | B2 * | 10/2007 | Hogsett | 343/872 |
| 2006/0092089 | A1 | 5/2006 | Courtney | |

OTHER PUBLICATIONS

Clark, Christopher, "Showing Some Skin", Business London, pp. 6 and 7, Feb. 2005.

* cited by examiner

*Primary Examiner*—Hoang V Nguyen
(74) *Attorney, Agent, or Firm*—Fasken Martineau DuMouli LLP

(57) ABSTRACT

The present invention relates generally to protective covers for satellite dishes having a dish reflector body including a front concave face, a rear convex face and a rim portion disposed between the front and rear faces thereof. The protective cover has a substantially rigid, cover body shaped to conform to, and fit over, the front concave face of the satellite dish. The cover body has a body wall constructed from a transparent material. The body wall has a front concave surface, an opposed rear convex face and a peripheral flange disposed therebetween. The peripheral flange extends about the cover body, rearwardly and away from the front concave face of the body wall. The protective cover further includes visual indicia carried on the rear convex face of the body wall. The visual indicia are protected by, and visible from behind, the body wall. When the protective cover is mounted onto the satellite dish, the rear convex face of the body wall is disposed adjacent the rear concave face of the dish reflector body and the peripheral flange of the body wall is disposed adjacent the rim portion of the dish reflector body.

16 Claims, 4 Drawing Sheets

PROTECTIVE COVER FOR A SATELLITE DISH

FIELD OF THE INVENTION

The present invention relates generally to protective covers for satellite dishes.

BACKGROUND OF THE INVENTION

With the emergence of domestic and international specialty television networks and channels, television signal receiving satellite dishes have become increasingly popular with viewers leading to the proliferation of satellite dishes in the urban landscape. To prevent signal interference, satellite dishes are typically installed outside a building on the rooftop or on a sidewall thereof. As a result, the satellite dishes tend to be exposed to inclement weather conditions, such as wind, rain, snow and ice. Exposure to the elements may adversely affect a satellite dish's signal receiving capability. In particular, the accumulation of snow or ice on the satellite dish may damage the dish reflector body and cause signal deterioration. If sufficient interference is present and the signals received fall below a predetermined threshold, television reception may be lost. To address this problem and protect the dish reflector body, various solutions have been proposed.

One such solution is described and shown in U.S. Pat. No. 6,933,908 issued to Mirabueno. This patent discloses a protective cover for satellite dishes that includes a rigid mounting plate removably securable to a support surface for mounting a satellite dish, and a dome section removably attachable to the mounting plate. The dome section is sized and shaped for housing the satellite dish therein and is formed from transparent fiberglass. When installed onto the satellite dish, the dome section of the protective cover fully encloses the satellite dish. The protective cover is also provided with a mechanism for contemporaneously rotating the satellite dish and a selected portion of the dome relative to the mounting plate. While this cover tends to adequately protect the satellite dish from external elements and other interferences, it tends to be bulky and cumbersome. With its plurality of moving parts, the costs associated with manufacturing such a cover tend be expensive and the installation of such a cover onto a support structure tends to be time-consuming and complicated. In addition, this type of protective cover may be ill-suited for use in conjunction with satellite dishes mounted on the vertical face of a building or structure.

Another approach is disclosed and shown in U.S. Pat. No. 5,815,125 issued to Kelly et al. The satellite dish cover described in this patent includes a flexible sheet material constructed and arranged for being disposed over the dish and feeder horn of the satellite dish assembly. The sheet includes a main body panel that wraps around the dish and the feeder horn and a secondary body panel that is sewn to the main body panel and is designed to extend from the rear of the dish to the dish support. The main body panel is designed to fit tightly over the dish and the feeder horn, but is prone, however, to sagging when snow or ice is disposed on the cover. To mitigate such sagging, a cinching mechanism is provided. The cinching mechanism, in the nature of a hook and loop fastener, is affixed to the feeder horn-receiving, end portion of the main body panel and is adapted to maintain the main body panel in tight fitting relation with the satellite dish. However, a drawback associated with this type of protective cover is that the cover does not lie substantially flat against the front face of the satellite dish and thus tends to present a large surface area which, in high wind areas, may catch the wind thereby subjecting the satellite cover and satellite dish to large forces and possibly significant vibrations. Additionally, the provision of a protective cover that shrouds both the dish and feeder horn may require a significant amount of material for a large satellite dish and tends not to be aesthetically pleasing.

In an attempt to overcome the foregoing shortcomings, alternate satellite dish covers have been developed, an example of which is described and shown in U.S. Pat. No. 5,940,047 issued to Pfnister. This patent discloses a cover that substantially conforms to the shape of the satellite dish. The cover has a first front portion and a second back portion sewn or otherwise attached to the front portion. When the cover is installed onto the satellite dish, the first front face is disposed adjacent the front concave surface of the satellite dish while the second back portion is disposed adjacent the back surface of the satellite dish. The cover may be constructed of a heavy, weather resistant flexible material such as a fabric. The dish cover further includes fastening mechanisms for allowing the dish cover to be releasably secured and closed about the dish cover. The patent further teaches that to enhance the aesthetic features of the cover, advertising material or decorative designs may be applied to the outer surface of the first front portion. While this constitutes an improvement over prior art protective covers, it tends to suffer from other disadvantages. More specifically, as a result of being tautly drawn against the concave face of the satellite dish, there is a tendency for unsightly wear lines to form on the cover along the points of contact with the satellite dish. In addition, the fabric may be prone to deformation from being overstretched, thereby resulting in the visual information displayed on the outer surface being distorted.

Other form-fitting fabric covers have been developed which at least partially avoid these problems. An example of one such cover is described and shown in U.S. Pat. No. 6,714,167 issued to Gusick, Jr. The fabric cover described in this patent is made of a substantially non-stretchable fabric sewn with a hem that coincides with the rim of the satellite dish to provide additional strength to the cover along the wear line of the cover against the rim. However, the fabric in these types of covers tends to deteriorate over time which can lead to sagging of the dish cover with deleterious effects on signal reception quality. In addition, fabrication of the cover may require the use of an expensive computer controlled cutting process.

United States Patent Application Publication No. 2006/0092089 of Courtney eschews the form-fitting cover made of fabric in favour of a cover constructed of a generally rigid weatherproof plastic, thereby avoiding the sagging problems encountered in prior art fabric covers. In one embodiment, the cover is formed with a generally rigid concave outer surface that is suitable for decorative and/or advertising use. While this type of cover constitutes an improvement over other known protective covers, applying a logo or decorative motif on the concave outer surface of the satellite dish cover tends to expose it to excessive wear resulting from constant exposure to the elements or various wind strewn debris, such as leaves and pine cones or needles. In time, the logo or decorative motif may get scratched off and/or its colours may fade thereby severely detracting from its aesthetic features. Additionally, in the field, signal degradation or loss has been experienced as a result of moisture infiltrating between the satellite and the cover, at times, leading to the formation of ice.

In light of the foregoing, it would be advantageous to have a protective satellite dish cover which could obviate the drawbacks associated with the prior art—one in which a logo or graphic could be suitably displayed and easily visible, while being protected from the harsh effects of the weather and the environment. It would be further desirable if such a protective cover could be relatively easy and inexpensive to manufacture.

SUMMARY OF THE INVENTION

In accordance with a broad aspect of an embodiment of the present invention, there is provided a protective cover for a satellite dish. The satellite dish has a dish reflector body that includes a front concave face, a rear convex face and a rim portion disposed between the front and rear faces thereof. The protective cover has a substantially rigid, cover body shaped to conform to, and fit over, the front concave face of the satellite dish. The cover body has a body wall constructed from a transparent material. The body wall has a front concave surface, an opposed rear convex face and a peripheral flange disposed therebetween. The peripheral flange extends about the cover body, rearwardly and away from the front concave face of the body wall. The protective cover further includes visual indicia carried on the rear convex face of the body wall. The visual indicia are protected by, and visible from behind, the body wall. When the protective cover is mounted onto the satellite dish, the rear convex face of the body wall is disposed adjacent the rear concave face of the dish reflector body and the peripheral flange of the body wall is disposed adjacent the rim portion of the dish reflector body.

In an additional feature, the transparent material is selected from the group consisting of: (a) polyvinyl chloride; (b) polyethylene terephthalate (PEI); (c) polyethylene terephthalate glycol-modified (PETG); (d) transparent acrylonitrile butadiene styrene (ABS); (e) celluseacetate (CA); (f) celluseacetate butyrate (CAB); (g) duroplas (EP/MF/PF/VF/UP/UR); (h) polyamyde (PA); (i) polyacetal (POM); (j) polyethylene (PE); (k) polypropylene (PP); (l) polycarbonate (PC); (m) polymethyl methacrylate (PMMA); (n) polystyrene (PS)-ABS-SAN; and (o) polyurethane (PU). In a further feature, the body wall is molded. Alternatively, the body wall is vacuum formed.

In still another feature, the visual indicia include at least one of text and graphical elements and depict at least one element selected from the group consisting of: (a) a promotional message; (b) a slogan; (c) a product advertising; (d) a decorative design; (e) a sports team logo; and (f) a company logo.

In yet another feature, the visual indicia are applied to the rear convex face of the body wall by screenprinting. In an alternate feature, the visual indicia are applied to the rear convex face of the body wall by digital printing techniques. In a further feature, the front concave face of the body wall has a smooth glossy finish to enhance viewing of the visual indicia.

In an additional feature, the protective cover further includes fastening means for securing the protective cover to the satellite dish. In one feature, the fastening means includes double-sided adhesive tape. The double-sided adhesive tape is affixed to the rear convex face of the body wall for attachment to the rear concave face of the satellite dish. Alternatively, the double-sided adhesive tape is affixed to the peripheral flange of the body wall for attachment to the rim portion of the dish reflector body. In another feature, the fastening means includes a hook and loop type fastener having a hook portion mounted to one of the protective cover and the satellite dish and a loop portion mounted to the other of the protective cover and the satellite dish. In still another feature, the fastening means includes a pair of spaced apart tabs extending from the peripheral flange of the body wall for snap-fit engagement with the rim portion of the dish reflector body.

BRIEF DESCRIPTION OF THE DRAWINGS

The embodiments of the present invention shall be more clearly understood with reference to the following detailed description of the embodiments of the invention taken in conjunction with the accompanying drawings, in which.

DETAILED DESCRIPTION OF THE EMBODIMENTS OF THE INVENTION

Figure 1:
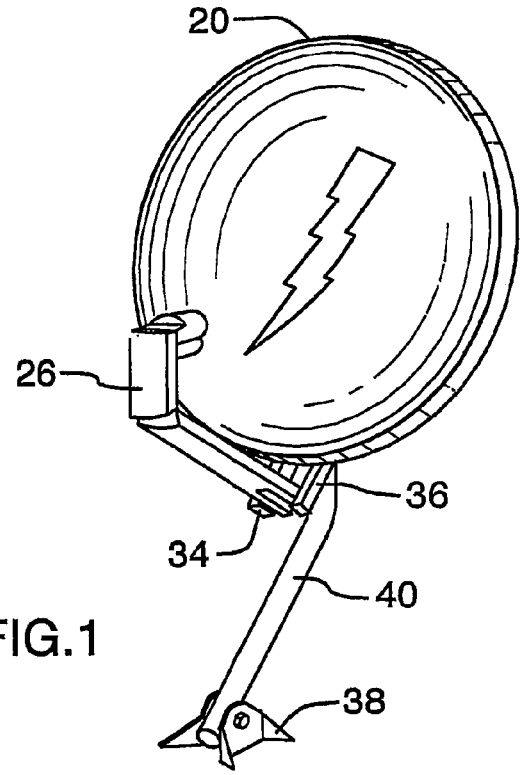
FIG. 1 is a front perspective view of a protective cover of a satellite dish according to an embodiment of the present invention shown operatively mounted onto a satellite dish.

The description which follows, and the embodiments described therein are provided by way of illustration of an example, or examples of particular embodiments of principles and aspects of the present invention. These examples are provided for the purposes of explanation and not of limitation, of those principles of the invention. In the description that follows, like parts are marked throughout the specification and the drawings with the same respective reference numerals.

Figure 2:
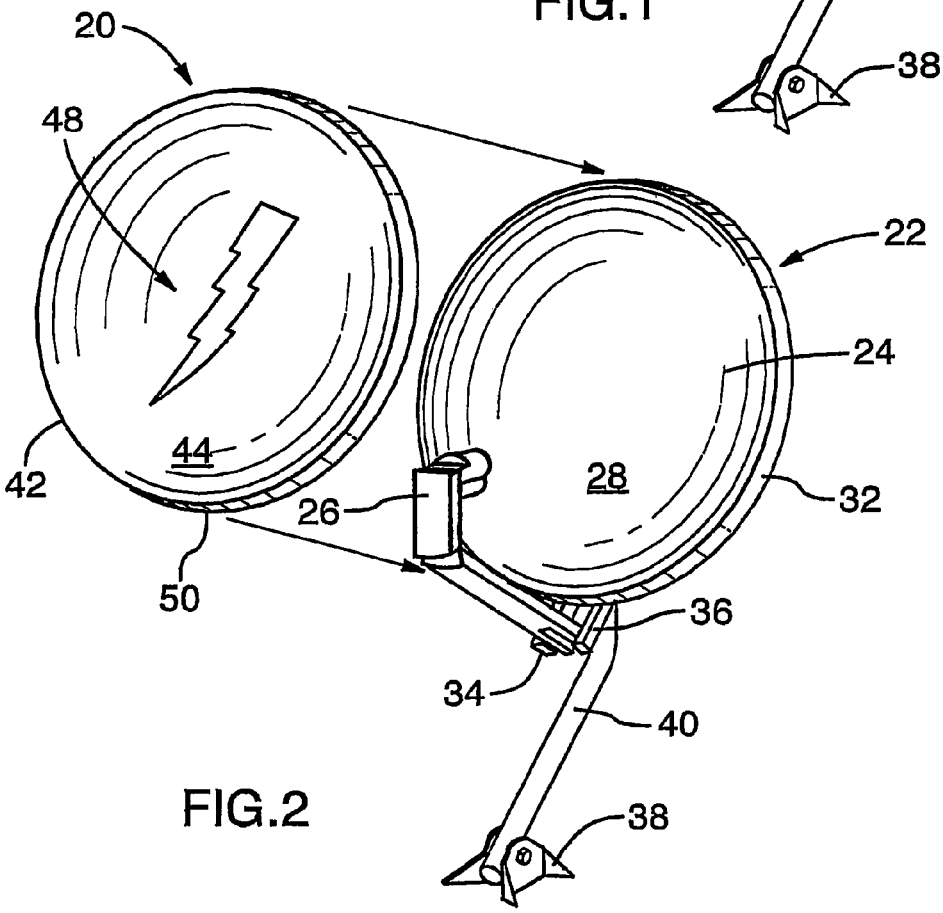
FIG. 2 is a perspective view of the protective cover similar to that illustrated in FIG. 1 showing the satellite dish cover exploded from the satellite dish.

Referring to FIGS. 1 and 2, there is shown a protective cover for a satellite dish, designated generally with reference numeral 20. The protective cover 20 is adapted to be mounted over the front face of satellite dish 22. The satellite dish 22 includes a generally parabolic-shaped, dish reflector body 24 and a feedhorn assembly 26 for gathering the satellite communication signals reflected from the dish body 24. The dish reflector body 24 has a front generally concave, signal-receiving face 28, a rear convex face 30 and a rim portion 32 disposed between the front and rear faces 28 and 30. The rim portion 32 extends about the periphery of the dish reflector body 24. The feedhorn assembly 26 is carried frontward of the front concave surface 28 at a predetermined location by a pair of support arms 34 and 36 that are anchored to the rear convex face 30 of the dish body 24.

The satellite dish 22 further includes a base 38 for securely mounting the satellite dish 22 to a support surface (not shown) such as, a rooftop or the sidewall of a building and a support leg 40 mounted at one end to the base 38. The support leg 40 extends away from the base 38 and has its second opposite end connected to a bracket (not shown) which is itself fastened to the rear convex face 30.

Figure 3:
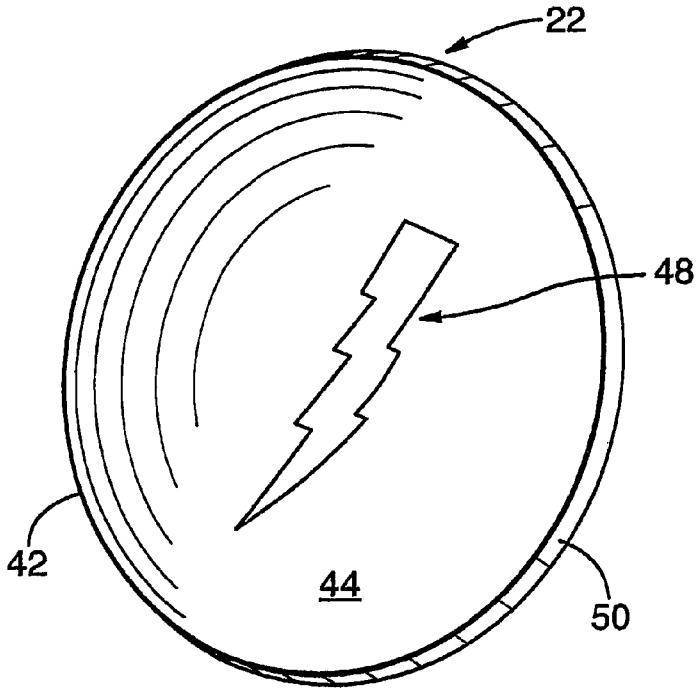
FIG. 3 is another front perspective view of the protective cover shown in FIG. 2.
Figure 4:
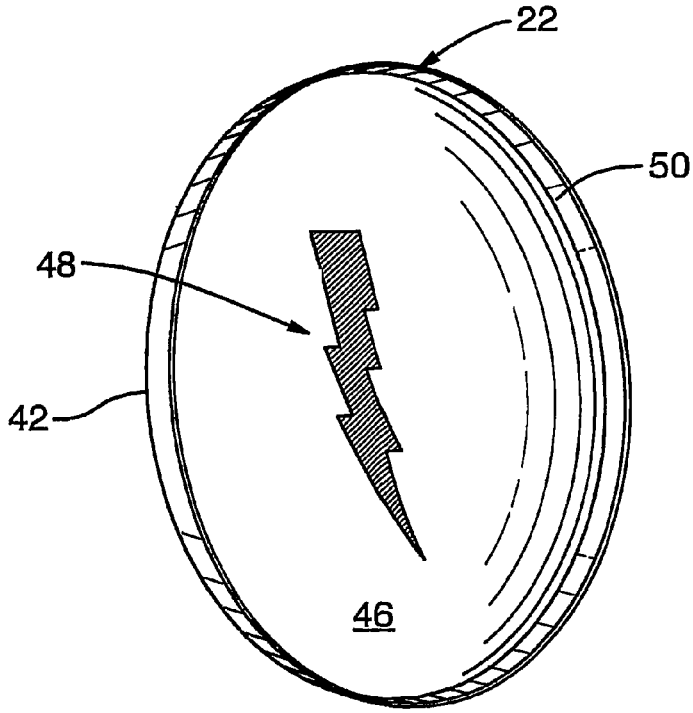
FIG. 4 is a rear perspective view of the protective cover shown in FIG. 3.
Figure 5:
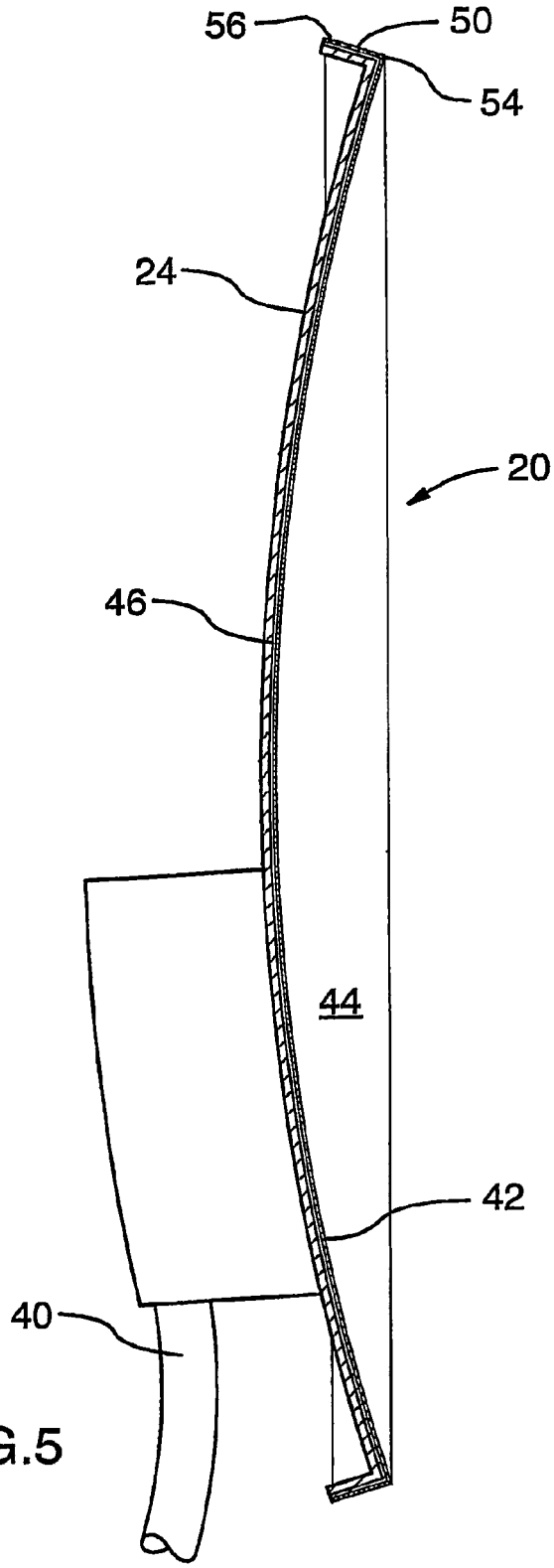
FIG. 5 is a sectional view of the protective cover shown in FIG. 3 taken along line "5-5" with the feedhorn assembly omitted for clarity.

Referring to FIGS. 3 and 4, the protective cover 20 is configured to generally conform to the parabolic shape of the dish reflector body 24 to minimize the profile of the satellite dish and cover. In particular, the protective cover 20 includes a relatively thin, molded body wall 42 which has a front concave face 44 and an opposed, rear convex face 46. The rear concave face 46 is adapted to carry thereon visual indicia 48. Additionally, the protective cover 20 is formed with a peripheral flange or lip 50 that extends rearwardly and away from the front concave face 44. When viewed in cross-section as shown in FIG. 5, the terminal edge 52 of the peripheral flange 50 can be seen to flare slightly radially outward relative to the proximal edge 54 thereof.

The satellite dish cover 20 is sized slightly larger than the dish reflector body 24 such that it can be placed to fit over the satellite dish 22 with its peripheral flange 50 abutting the rim portion 32 of the dish body 24. In this embodiment, the protective cover is releasably secured to the dish reflector body 24 with double-sided adhesive tape (not shown). Strips of adhesive tape are affixed to the rear convex face 46 of the satellite dish cover 20 at spaced apart locations. Thereafter, the protective cover 20 is centred with the dish reflector body 24 and the rear convex face 46 of the protective cover 20 is urged to abut the front concave face 28 of the dish reflector body 24 to thereby cause the strips of tape to adhere to the front concave face 28. In an alternative embodiment, strips of adhesive tape could be affixed to the peripheral flange 50 for adhesion to either the rear convex face 30 or the peripheral rim portion 32 of the satellite dish 22. Other attachment techniques may also be employed to similar advantage. For instance, it may be possible to use hook and loop type fasteners instead of double-sided adhesive tape. In such an embodiment, the hook portion of the fastener could be mounted on one of the protective cover or the satellite dish itself with the loop portion being attached on the other one thereof. Alternatively, the peripheral flange of the protective cover could be configured with a pair of spring-like, spaced apart flaps or tabs adapted for snap-fit engagement with the peripheral rim portion of the dish reflector body in the manner described and shown in United States Patent Application Publication No. 2006/0092089 of Courtney; the disclosure of which is hereby incorporated by reference.

The visual indicia 48 may include text and/or graphical elements depicting promotional messages, slogans, product advertising, decorative designs or motifs, sports team logos, company logos and/or the like. In this exemplary embodiment, the visual indicia 48 is a graphical representation a lightning bolt. The visual indicia 48 may be applied to the rear convex face 46 of the protective cover 20 using screen-printing (or silkscreening) or digital printing techniques (including digitized offset process printing or four-colour process printing) and inks resistant to ultraviolet (UV) radiation. In alternative embodiments, the visual indicia could be applied to the rear convex face of the protective cover in other ways, for instance, by affixing an adhesive decal, sticker or label thereon. The vast array of visual indicia to choose from and the ease with which such visual indicia may be applied on the protective cover, provides the user (satellite dish owner) with the opportunity to customize his or her protective cover such that it becomes a vanity satellite dish cover.

Having the visual indicia 48 carried on the rear convex face 46 tends to minimize signal loss and degradation. With the ink layer disposed closer to the signal receiving front concave face 28 of the satellite dish 22, the ink layer's ability to obstruct or absorb the signal tends to be mitigated. In the preferred embodiment, the thickness of the molded body is between about 0.20 mm and 0.30 mm.

The protective cover 20 is of unitary construction and is made of a substantially rigid, durable and weather resistant material which has been molded or vacuum formed into the desired shape. More specifically, it tends to have a high tensile strength, tends to be waterproof and tends to exhibit excellent resistance to cracking and warping caused by extremes in ambient temperature (i.e. extreme heat or cold). Moreover, the material does not to interfere with the transmission/reception of satellite communication signals and affords protection against ultra-violet (UV) radiation.

Figure 6:
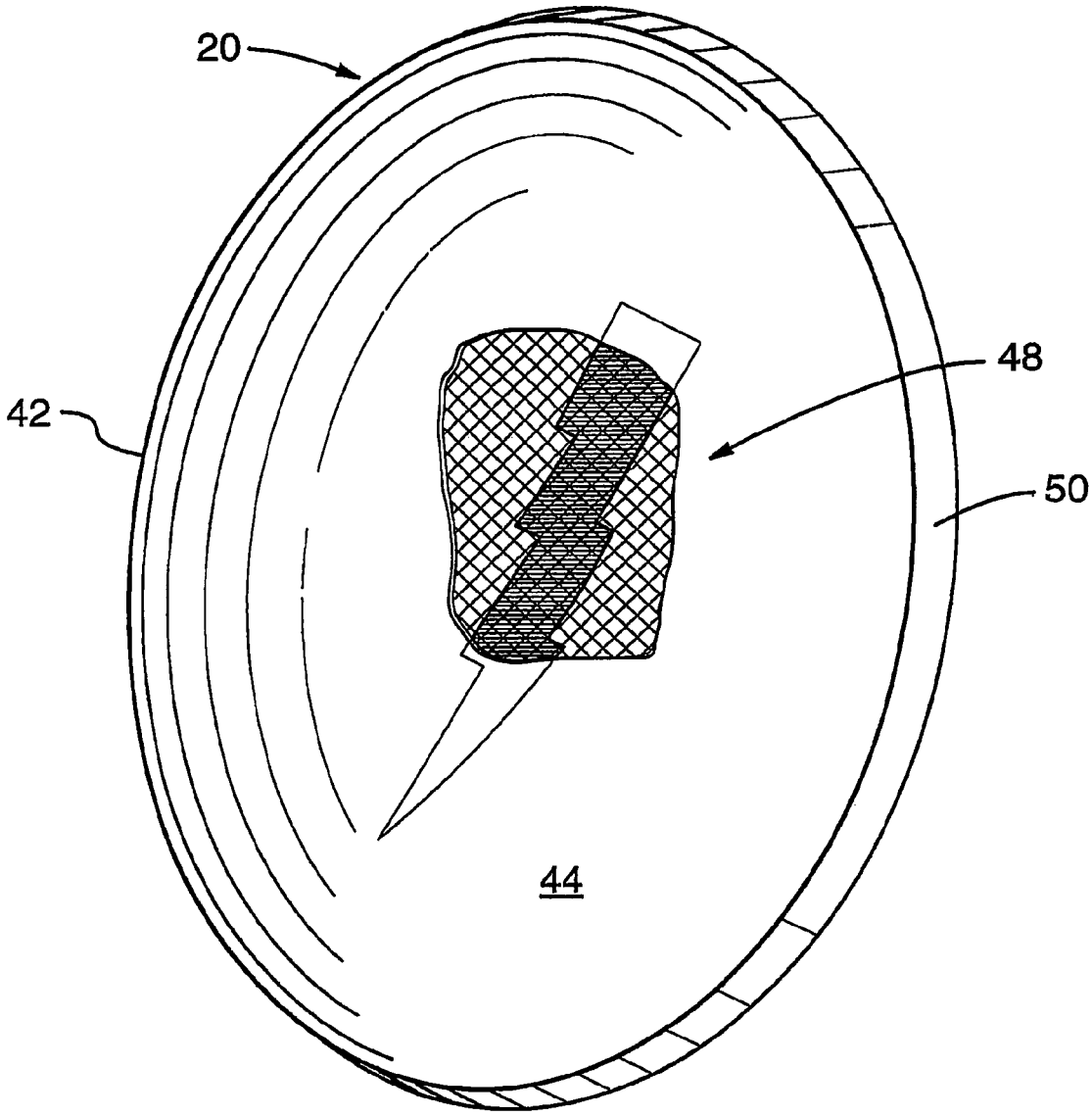
FIG. 6 is a front perspective view similar to that shown in FIG. 1 with a portion of the front concave face of the molded body cut away to reveal therebehind the visual indicia applied to the rear convex face of the protective cover.

To enable the visual indicia 48 carried on the rear convex face 46 to be displayed when the protective cover 20 is mounted onto the satellite dish 22, a clear transparent material is employed (see FIG. 6). Advantageously, use of a transparent material permits the visual indicia 48 to be clearly viewed from behind a protective screen defined by the body wall 42 of the protective cover 20. To further enhance viewing of the visual indicia 48, the front concave face 46 of the protective cover 20 has a smooth glossy finish which tends to vividly bring out the colours of the visual indicia. The smooth finish tends to impart low adhesion characteristics to the dish cover that encourages release of any snow or ice that might form on the front concave face 46.

It will thus be appreciated that, in contrast to prior art protective covers which have logos or graphical elements displayed on the outer surfaces of the covers and as a result tend to experience premature wear, the visual indicia 48 is afforded enhanced protection from damage (i.e. scratches, or colour fading) caused by direct exposure to inclement weather. Advantageously, the aesthetic appeal of the protective cover 20 may be preserved for a longer period of time thereby obviating the need for frequent replacement of the protective cover and the additional expenses associated therewith.

In the preferred embodiment, the protective cover 20 is fabricated from transparent polyvinyl chloride (either rigid or plasticized PVC). In other embodiments, alternative materials exhibiting similar material properties may be also used. Such materials include transparent polyethylene terephthalate (PET), polyethylene terephthalate glycol-modified (PETG), transparent acrylonitrile butadiene styrene (ABS), celluseacetate (CA), celluseacetate butyrate (CAB), duroplas (EP/MF/PF/VF/UP/UR), polyamyde (A), polyacetal (POM), polyethylene (PE)/Polypropylene (PP), polycarbonate (PC), polymethyl methacrylate (PMMA), polystyrene (PS)-ABS-SAN, polyurethane (PU) and other similar plastics and thermoplastics.

It will be appreciated that protective covers constructed in accordance with the principles of the present invention could be adapted to fit over satellite dishes of varying shapes and sizes. Also, it should be understood that such protective covers could be used on many different types of satellite dishes, including but not limited to television satellite dishes.

Although the foregoing description and accompanying drawings relate to specific preferred embodiments of the present invention as presently contemplated by the inventor, it will be understood that various changes, modifications and adaptations, may be made without departing from the spirit of the invention.

What is claimed is:

1. A protective cover for a satellite dish having a dish reflector body, the dish reflector body including a front concave face, a rear convex face and a rim portion disposed between the front and rear faces thereof, the protective cover comprising:

a substantially rigid, cover body shaped to conform to, and fit over, the front concave face of the satellite dish; the cover body having a body wall constructed from a transparent material; the body wall having a front concave surface, an opposed rear convex face and a peripheral flange disposed therebetween; the peripheral flange extending about the cover body, rearwardly and away from the front concave face of the body wall; and visual indicia carried on the rear convex face of the body wall; the visual indicia being protected by, and visible from behind, the body wall;

when the protective cover is mounted onto the satellite dish, the rear convex face of the body wall is disposed adjacent the rear concave face of the dish reflector body and the peripheral flange of the body wall is disposed adjacent the rim portion of the dish reflector body.

2. The protective cover of claim 1 wherein the transparent material is selected from the group consisting of: (a) polyvinyl chloride; (b) polyethylene terephthalate (PET); (c) polyethylene terephthalate glycol-modified (PETG); (d) transparent acrylonitrile butadiene styrene (ABS); (e) celluseacetate (CA); (f) celluseacetate butyrate (CAB); (g) duroplas (EP/MF/PF/VF/UP/UR); (h) polyamyde (PA); (i) polyacetal (POM); (j) polyethylene (PB); (k) polypropylene (PP); (l) polycarbonate (PC); (m) polymethyl methacrylate (PMMA); (n) polystyrene (PS)-ABS-SAN; and (o) polyurethane (PU).

3. The protective cover of claim 1 wherein the body wall is molded.

4. The protective cover of claim 1 wherein the body wall is vacuum formed.

5. The protective cover of claim 1 wherein the visual indicia include at least one of text and graphical elements.

6. The protective cover of claim 5 wherein the visual indicia depict at least one element selected from the group consisting of: (a) a promotional message; (b) a slogan; (c) a product advertising, (d) a decorative design; (e) a sports team logo; and (f) a company logo.

7. The protective cover of claim 1 wherein the visual indicia are applied to the rear convex face of the body wall by screenprinting.

8. The protective cover of claim 1 wherein the visual indicia are applied to the rear convex face of the body wall by digital printing techniques.

9. The protective cover of claim 1 wherein the front concave face of the body wall has a smooth glossy finish to enhance viewing of the visual indicia.

10. The protective cover of claim 1 further including fastening means for releasably securing the protective cover to the satellite dish.

11. The protective cover of claim 10 wherein the fastening means includes double-sided adhesive tape.

12. The protective cover of claim 11 wherein the double-sided adhesive tape is affixed to the rear convex face of the body wall for attachment to the rear concave face of the satellite dish.

13. The protective cover of claim 11 wherein the double-sided adhesive tape is affixed to the peripheral flange of the body wall for attachment to the rim portion of the dish reflector body.

14. The protective cover of claim 10 wherein the fastening means includes a hook and loop type fastener having a hook portion mounted to one of the protective cover and the satellite dish and a loop portion mounted to the other of the protective cover and the satellite dish.

15. The protective cover of claim 14 wherein the fastening means includes a pair of spaced apart tabs extending from the peripheral flange of the body wall for snap-fit engagement with the rim portion of the dish reflector body.

16. The protective cover of claim 1 wherein the satellite dish is a television satellite dish.

* * * * *